US007372439B2

(12) United States Patent
Yaguma et al.

(10) Patent No.: US 7,372,439 B2
(45) Date of Patent: May 13, 2008

(54) REFERENCE CURRENT GENERATOR CIRCUIT OF ORGANIC EL DRIVE CIRCUIT, ORGANIC EL DRIVE CIRCUIT AND ORGANIC EL DISPLAY DEVICE

(75) Inventors: Hiroshi Yaguma, Kyoto (JP); Masanori Fujisawa, Kyoto (JP); Shinichi Abe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 446 days.

(21) Appl. No.: 11/114,179

(22) Filed: Apr. 26, 2005

(65) Prior Publication Data

US 2005/0237284 A1 Oct. 27, 2005

(30) Foreign Application Priority Data

Apr. 27, 2004 (JP) ..... 2004-131013

(51) Int. Cl.
*G09G 3/30* (2006.01)

(52) U.S. Cl. ..... 345/76

(58) Field of Classification Search ..... 345/76, 345/82; 315/169.3; 313/499, 500; 257/59; 438/149

See application file for complete search history.

(56) References Cited

FOREIGN PATENT DOCUMENTS

JP 2001-34221 2/2001

*Primary Examiner*—Richard Hjerpe
*Assistant Examiner*—Abbas I. Abdulselam
(74) *Attorney, Agent, or Firm*—Mattingly, Stanger, Malur & Brundidge, PC

(57) ABSTRACT

A first current mirror circuit including an input side transistor, an output transistor and passive elements respectively connected in series with said input side transistor and said output side transistor, temperature coefficients of said passive elements being opposite in characteristics and a second current mirror circuit provided as a load circuit of the first current mirror circuit, for feeding back an output current of the output side transistor to an input of the input side transistor are provided. A drive current is generated on a basis of a current corresponding to a current generated in the output side transistor as a reference current and an operating current ratio of the input side transistor and the output side transistor is selected such that luminance change of organic EL elements with respect to temperature change is restricted.

23 Claims, 3 Drawing Sheets

REFERENCE CURRENT GENERATOR CIRCUIT OF ORGANIC EL DRIVE CIRCUIT, ORGANIC EL DRIVE CIRCUIT AND ORGANIC EL DISPLAY DEVICE

BACKGROUND OF THE INVENTION

1. Field of the Invention

The present invention relates to a reference current generator circuit of an organic EL drive circuit, an organic EL drive circuit using the same reference current generator circuit and an organic EL display device using the same organic EL drive circuit. Particularly, the present invention relates to a reference current generator circuit for a display device of an electronic device such as a portable telephone set or a PHS, which is suitable for use in high luminance color display and with which white balance of the display device is unchanged within a wide temperature range by preventing loss of white balance due to change of temperature environment of the display device.

2. Description of the Related Art

An organic EL display panel of an organic EL display device for use in a portable telephone set, a PHS, a DVD player, PDA (portable digital assistances), etc., including 396 (132×3) terminal pins for column lines and 162 terminal pins for row lines has been proposed. The number of the terminal pins for column lines and row lines is still increasing.

An output stage of a current drive circuit of a conventional organic EL display panel of either the active matrix type or the passive matrix type includes output circuits, which are provided correspondingly to respective terminal pins of the panel and each of which is constructed with a current source drive circuit constructed with such as, for example, a current mirror circuit.

Further, in order to keep white balance on a display screen of a color organic EL display panel unchanged by regulating luminance of R (red), G (green) and B (blue) primary colors on the screen correspondingly to organic EL materials for the primary colors, the current drive circuit of the color organic EL display panel includes regulation circuits for luminance regulation of the respective R, G and B colors on the screen.

Each of the current drive circuit for driving the organic EL elements for R, G and B colors arranged in a matrix usually includes a single reference current generator circuit commonly used for R, G and B colors and reference current setting circuits provided correspondingly to the respective R. G and B. The reference current setting circuits provided correspondingly to the respective primary colors regulate a reference current generated by the single reference current generator circuit to generate reference currents corresponding to the respective primary colors. White balance on the display screen is realized by regulating the reference current by the reference current setting circuits. The thus regulated reference currents for R, G and B colors are supplied to the drive circuits for the respective R, G and B colors.

JP2001-34221A discloses a technique in which an organic EL element emits light by supplying a constant current from a constant current setting circuit to a drive circuit of the organic EL element and driving the drive circuit with PWM pulse and in which reduction of intensity of emitted light due to aging is recovered by regulating the current from the constant current setting circuit.

In general, an electronic device, which has an organic EL display device, is operable in a wide temperature range (temperature environment) from −10° C. to +70° C. In such wide operable temperature range of the display device, loss of white balance on a display screen due to environmental temperature change of the electronic device in such temperature range becomes a problem in, particularly, a case where the organic EL display device is a high luminance color organic EL display device. Such loss of white balance on the display screen is caused by the fact that the light emitting characteristics of R, G and B colors are changed correspondingly to temperature and dependently upon luminous material forming the organic EL elements.

Presently, a temperature characteristics R of a luminous material for R color is linearly reducing with increase of temperature as shown by a solid line in FIG. 3(*a*). A temperature characteristics G of a luminous material for G color is represented by a concaved curve having minimum value at a center portion in the vicinity of 0° C. as shown by a solid line in FIG. 3(*b*) and a temperature characteristics B of a luminous material for B color is linearly increasing with increase of temperature as shown by a solid line in FIG. 3(*c*).

Incidentally, ordinate in FIG. 3(*a*) to FIG. 3(*c*) indicates ratio of luminance Po to output current Io, that is, luminance per unit drive current (Po/Io) and abscissa indicates temperature (° C.). Luminance Po of luminous material is usually linear with respect to the output current Io in the operable temperature range of the organic EL element and temperature characteristics of the R, G and B colors are different from each other.

As a result, white balance on the display screen of the display device, which is set at a center temperature, which is usually normal temperature such as 25° C., in the temperature range may be lost if the operable temperature of the display device is changed within the operable temperature range from −10° C. to +70° C.

SUMMARY OF THE INVENTION

An object of the present invention is to provide a reference current generator circuit of an organic EL drive circuit, which is capable of preventing luminance of an organic EL display device from being changed in a wide operable temperature range of the display device.

Another object of the present invention is to provide an organic EL element drive circuit capable of keeping white balance of a display device in a wide temperature range and of preventing loss of white balance due to temperature change during use of the display device.

A further object of the present invention is to provide an organic EL display device using the same organic EL element drive circuit.

According to the present invention, the above objects are achieved by providing a reference current generator circuit of an organic EL element drive circuit, for generating a drive current of each of terminal pins of an organic EL panel to drive the organic EL panel, which is featured by comprising a first current mirror circuit including passive elements respectively connected in series with an input side transistor and an output side transistor and having opposite temperature coefficients and a second current mirror circuit provided as a load circuit of the first current mirror circuit, for feeding back an output current of the output side transistor to an input of the input side transistor, wherein the drive current is generated according to a current corresponding to a current generated on the side of the output side transistor as the reference current and ratio of operating currents of the input side transistor and the output side transistor is selected such that luminance change of the organic EL element due to temperature change thereof is corrected in a direction in which the luminance change is restricted.

As mentioned above, in the present invention, the current of the output side transistor of the first current mirror circuit is fed back to the input side transistor thereof through the second current mirror circuit, which is an active load of the first current mirror circuit, so that a current corresponding to a voltage difference between the passive elements having temperature coefficient, which are positive and negative upon temperature change, respectively, is supplied to the output side transistors of the first current mirror circuit through the input side transistor thereof. Thus, it is possible to stably generate a large current having a temperature coefficient, which is determined by a predetermined function reflecting the positive and negative temperature coefficients of the passive elements. The large current reflecting the positive and negative temperature coefficients of the passive elements is derived as the reference current from the output side transistors of the first current mirror circuit.

Further, in order to correct the luminance change characteristics of the organic EL element with respect to temperature in a direction in which the change characteristics is not substantially changed, the reference current is generated by selecting the operating current ratio of the input side transistor and the output side transistor of the first current mirror circuit, that is, operating current ratio.

Incidentally, it is possible, by this selection of the operating current ratio, to obtain a reference current having negative temperature characteristics reflecting the positive and negative characteristics of the passive elements, a reference current having positive temperature characteristics reflecting the positive and negative characteristics of the passive elements and a reference current having positive and negative temperature characteristics reflecting the positive and negative characteristics of the passive elements.

Thus, it is possible to obtain, from the reference current having either one of the above mentioned temperature characteristics, the drive current for correcting luminance of the organic EL element in a direction in which luminance of the organic EL element is almost unchanged even when temperature of the display device is changed within a wide range from about −10° C. to about +70° C.

Particularly, by obtaining respective reference currents having the temperature characteristics for correcting the luminance change with respect to temperature of the organic EL elements for R, G and B colors in directions in which the luminance are not substantially changed by the selection of the operating current ratios, it is possible, in a color display device used in the temperature range from about −10° C. to about +70° C., to prevent white balance on the color display device from being lost.

As a result, change of luminance of a color display device within the wide temperature range is prevented and white balance of the color display device can be kept unchanged in the wide temperature range within which the color display device is used.

DETAILED DESCRIPTION OF THE PREFERRED EMBODIMENTS

Figure 1:
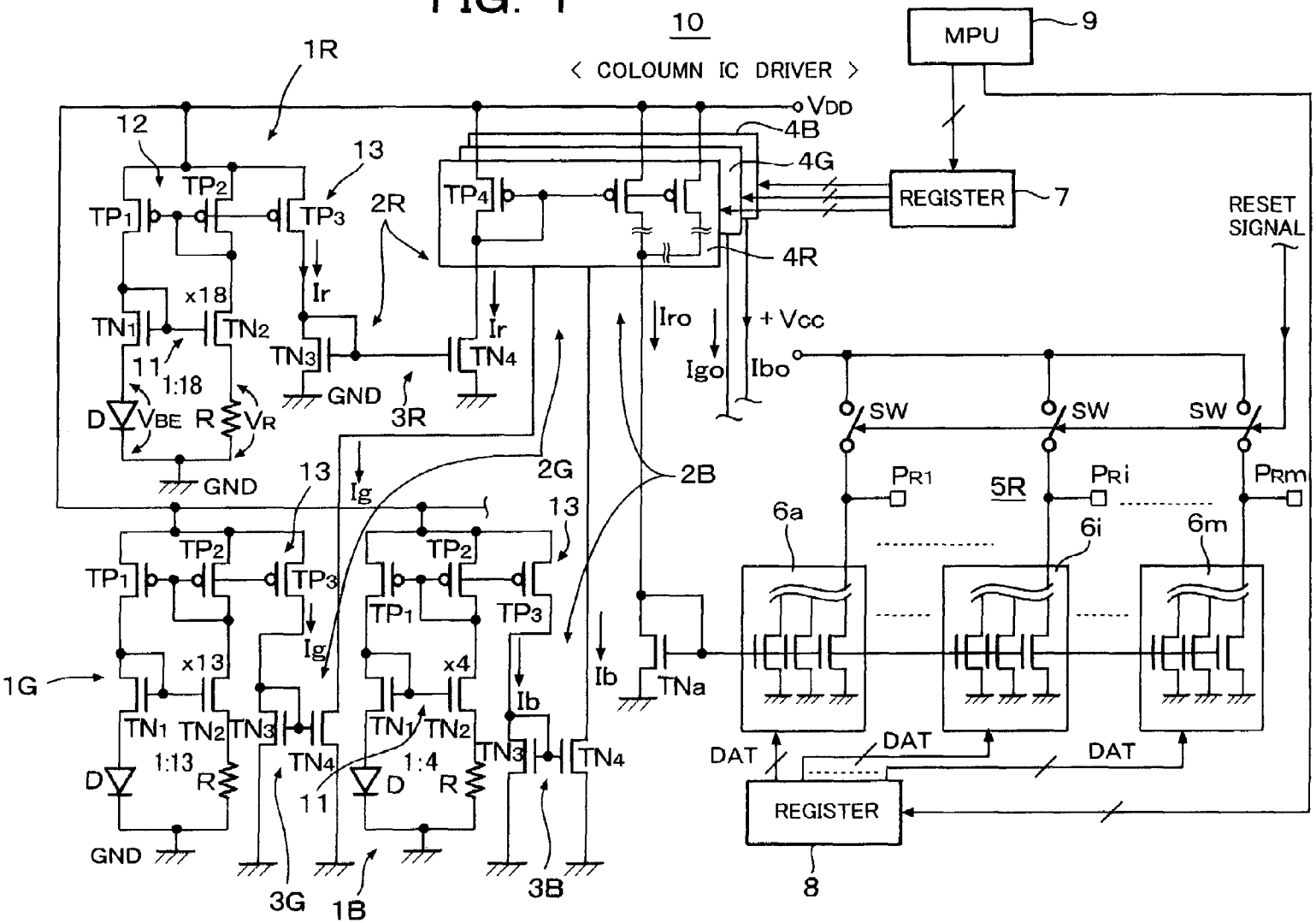
FIG. 1 is a block circuit diagram of a column driver of an organic EL panel using an organic EL drive circuit according to an embodiment of the present invention.

In FIG. 1, a reference numeral 10 depicts a column IC driver (referred to as "column driver", hereinafter) as an organic EL drive circuit for driving organic EL elements. The column driver 10 includes a reference current generator circuit 1R corresponding to R (red) color, a reference current generator circuit 1G corresponding to G (green) color and a reference current generator circuit 1B corresponding to B (blue) color. Further, the column driver 10 includes white balance regulator circuits 2R, 2G and 2B for regulating reference currents for respective R, G and B colors of the reference current generator circuits 1R, 1G and 1B.

The white balance regulator circuit 2R is composed of a current inverter circuit 3R and an 8-bit D/A converter circuit 4R. The white balance regulator circuit 2G is composed of a current inverter circuit 3G and an 8-bit D/A converter circuit 4G and the white balance regulator circuit 2B is composed of a current inverter circuit 3B and an 8-bit D/A converter circuit 4B. The current inverter circuits 3R, 3G and 3B of the respective white balance regulator circuits 2R, 2G and 2B are supplied with reference currents Ir, Ig and Ib from the reference current generator circuits 1R, 1G and 1B, respectively. The 8-bit D/A converter circuits 4R, 4G and 4B, each of which is composed of a current mirror circuit, regulate the reference currents. Thus, the D/A converter circuits 4R, 4G and 4B generate reference currents (referred to as "reference drive currents", hereinafter) Iro, Igo and Ibo, which are regulated correspondingly to R, G and B colors, respectively.

Data corresponding to R, G and B colors are stored in a register 7. The data is set in the register 7 by temporarily storing the data, which is externally supplied to an MPU 9, in a non-volatile memory, etc., of the MPU 9 and then transferring the data to the register 7. The reference drive currents Iro, Igo and Ibo are generated by setting the data in the D/A converter circuits 4R, 4G and 4B and converting the data stored in the register 7 into analog values. The data is set in the register 7 by temporarily storing the data, which is externally supplied to an MPU 9, in a non-volatile memory, etc., of the MPU 9 and then transferring the data to the register 7.

The reference drive currents Iro, Igo and Ibo generated by the white balance regulator circuits 2R, 2G and 2B drive the input side transistor of current mirror circuits 5R, 5G and 5B corresponding to R, G and B colors, respectively. Thus, the current mirror circuits 5R, 5G and 5B distribute the reference drive currents Iro, Igo and Ibo to output side transistors thereof, which are provided correspondingly to output terminals for R, G and B colors, respectively.

Incidentally, since the white balance regulator circuits 2R, 2G and 2B have identical circuit constructions and the current mirror circuits 5G and 5B connected to the respective white balance regulator circuits 2G and 2B are identical in circuit construction to that of the current mirror circuit 5R connected to the white balance regulator circuit 2R. Therefore, the current mirror circuits 5G and 5B for G and B colors are not shown in FIG. 1. Although basic circuit constructions of the reference current generator circuits 1R, 1G and 1B are identical as shown in FIG. 1, channel width ratio of the transistors constructing the current mirror circuits are different.

In the following description, the reference current generator circuit 1R, the white balance regulator circuit 2R and the current mirror circuit 5R will be described mainly. Since basic circuit construction and operations of the reference current generator circuits 1G and 1B are similar to those of the reference current generator circuit 1R, basic circuit constructions and operations of the white balance regulator circuits 2G and 2B are similar to those of the white balance regulator circuit 2R and basic circuit constructions and operations of the current mirror circuits 5G and 5B are similar to those of the current mirror circuit 5R, detailed description of the circuit constructions and operations for G and B colors are omitted.

Each of the reference current generator circuits 1R, 1G and 1B is a constant current circuit for outputting a current (reference current), which is variable correspondingly to environmental temperature change. Each reference current generator circuit is composed of a current mirror circuit 11, a load circuit (current mirror circuit) 12, which acts as an active load of the current mirror circuit 11, and a reference current output circuit 13 connected to the load circuit 12.

A diode D is constructed with, for example, a diode-connected transistor and generates a voltage VBE, which has negative temperature characteristics and corresponds to a band gap voltage between a base and an emitter of the transistor. The diode D is inserted between a source of an input side N channel MOS transistor TN1 of the current mirror circuit 11 and ground GND. Further, a resister R having positive temperature characteristics is inserted between a source of an output side N channel MOS transistor TN2 of the current mirror circuit 11 and ground GND.

Gates of the transistors TN1 and TN2 are commonly connected to a drain of the transistor TN1 and a drain of the transistor TN2 is connected to common gates of P channel MOS transistors TP1 and TP2 of the current mirror circuit as the load circuit 12, respectively. The load circuit 12 is connected to a power source line +VDD through the transistors TP1 and TP2. The transistor TP2 of the load circuit 12 is a diode-connected input side transistor and the transistors TP1 is an output side transistor of the same current mirror circuit.

The reference current output circuit 13 is composed of an output side P channel MOS transistor TP3, which constitutes a current mirror together with the transistor TP2 of the load circuit 12.

In the circuit construction mentioned above, a current of the output side transistor TN2 of the current mirror circuit 11 is fed back to the input side transistor TN1 of the current mirror circuit 11 through the input side transistor TP2 of the load circuit 12 as the active load of the current mirror circuit 11 and the output side transistors TP1. A current corresponding to a voltage difference between the diode D having negative temperature coefficient depending upon temperature change and the resistor R having positive temperature coefficient depending upon temperature change is supplied to the output side transistor TN2 through the input side transistor TN1 of the current mirror circuit. Thus, it is possible to stably generate a large current having a predetermined temperature coefficient determined by a function, which reflects positive and negative temperature characteristics in the output side transistor TN2.

Difference between the reference current generator circuits 1R, 1G and 1B resides in channel width ratio of the transistors TN1 and TN2 of the current mirror circuit 11. That is, the channel width ratios of the transistors TN1 and TN2 of the reference current generator circuit 1R, the transistors TN1 and TN2 of the reference current generator circuit 1G and the transistors TN1 and TN2 of the reference current generator circuit 1B are 1:18, 1:13 and 1:4, respectively.

Incidentally, an arbitrary channel width (gate width) ratio 1:n (n is an integer not smaller than 2) of the current mirror circuit 11 of each reference current generator circuit can be realized by connecting a plurality (n) of output side transistors in parallel, when the gate widths of the input side transistor and the output side transistors are identical.

A current inverter circuit 3R of the white balance regulator circuit 2R is constructed with a current mirror circuit composed of an N channel input side MOS transistor TN3 and an output side MOS transistor TN4 as shown in FIG. 1. The transistor TN3 is diode-connected and has a drain connected to a drain of the P channel MOS transistor TP3 of the reference current output circuit 13. The transistor TN3 is supplied with the reference current Ir.

A transistor TN4 has a drain connected to a drain of an input side transistor TP4 of the current mirror circuit of the D/A converter circuit 4R and a source grounded.

Thus, the reference current Ir discharged from the reference current output circuit 13 is inputted to the current inverter circuit 3R, inverted thereby to a sink current and outputted as a mirror current. The sink current is supplied to the drain of the input side transistor TP4 of the D/A converter circuit 4R. The latter transistor TP4 is driven by the current Ir.

The D/A converter circuit 4R regulates the reference current Ir according to the data stored in the register 7 and outputs a regulated reference drive current Iro. Incidentally, since the D/A converter circuit 4R is a current switching D/A converter having a current mirror circuit construction, the D/A converter circuit 4R amplifies the reference current Ir and generates the regulated analog converted current as the reference drive current Iro by selecting one of currents of the output side transistors of the current mirror circuit by means of a switch circuit, which is ON/OFF controlled according to the digital value set in the register 7.

The current mirror circuit 5R constitutes a reference current distributor type D/A converter circuit.

That is, in the 1:n current mirror circuit constructed with a single input side transistor and a plurality (n) of output side transistors (n corresponds to the number of the output terminals) and constituting the reference current distributor circuit, the n output side transistors are replaced by n current switching D/A converter portions. Currents of the output side transistors of each D/A converter portion are switched according to the digital value and distributed to the respective output terminal pins as analog converted currents.

As shown in FIG. 1, the portion in which the analog converted currents are generated is given as D/A conversion blocks 6*a* to 6*m* each including a plurality of output side transistors provided correspondingly to the output terminal pins with respect to at least one input side transistor TNa.

Each of the D/A conversion blocks 6*a* to 6*m* is composed of a plurality of output side transistors, which constitute, together with the N channel input side MOS transistor TNa, a current mirror circuit and are weighted correspondingly to weights of the 8-bit display data to be converted, and a corresponding number of switch circuits (not shown) connected to the respective output side transistors.

A drain of the transistor TNa is connected to an output of the D/A converter circuit 4R and driven by the regulated reference drive current Iro. A source of the transistor TNa is grounded.

By constructing the current mirror circuit 5R with the reference current distributor type D/A converter circuit, it is possible to reduce the size of a circuit from the reference current distributor to the D/A converter circuit in the column driver 10 provided as an IC.

In each of the D/A conversion blocks 6*a* to 6*m*, the current outputs of the output side transistors are selected by the switch circuits, which are ON/OFF controlled correspondingly to the 8-bit display data from a register 8 and a synthesized output of the selected output currents, is generated as the analog converted value. The analog converted current is supplied to output terminals PR1, . . . PRi, . . . PRm of the D/A conversion blocks 6*a* to 6*m*.

Incidentally, sources of the output side transistors of the D/A conversion blocks are grounded.

As a result, the D/A conversion blocks 6*a* to 6*m* generate, at their output terminals PR1, . . . PRi, . . . PRm, drive currents (usually, sink currents) corresponding to luminance of the display data DAT received from the MPU 9 through the register 8 by amplifying the reference drive current Iro according to the display data value every moment. These drive currents are outputted to m data lines (column lines) for R color of the active matrix type organic EL panel (not shown). Thus, the respective drive currents are sent to pixel circuits through the data line and charge capacitors C housed in the pixel circuits for R color to drive the organic EL elements in the pixel circuits.

The drive operation of the D/A conversion blocks for G and B colors, which are responsive to the reference drive currents Igo and Ibo generated by the white balance regulator circuits 2G and 2B are similar to that for R color.

Incidentally, analog switches SW for resetting the constant voltage are provided between the power source line +Vcc and the output terminals PR1, . . . PRi, . . . PRm of the respective D/A conversion blocks 6*a* to 6*m*.

Considering a circuit having an input as a gate of the transistor TN2 of the current mirror circuit 11 of the reference current generator circuit 1R and an output as a drain of the transistor TN2, a gate voltage of the transistor TN2 is changed correspondingly to a change of a source voltage, which is caused by environmental temperature according to the temperature characteristics of the value of the resistor R. The drain output current of the transistor TN2 drives the transistor TP2 and, therefore, the transistor TP1 current-mirror connected to the transistor TP2. The drain of the transistor TP1 is connected to the gate of the transistor TN2 through the diode connection thereof to the input side transistor TN1. Therefore, a feed back loop from the drain of the transistor TP1 to the gate of the transistor TN2.

On the other hand, the gate voltage of the input side transistor TN1 is changed correspondingly to a change of the source voltage, which is changed corresponding to environmental temperature according to the temperature characteristics of the diode D.

As a result, the input voltage of the transistor TN2 is feed-back controlled in such a way that it becomes the same as the drain voltage determined correspondingly to the drain current of the transistor TN2, which is generated correspondingly to the temperature change dependent difference between the voltage VBE of the diode D and the voltage VR of the resistor R.

Thus, the reference current generator circuit 1 is stabilized when the gate voltage of the transistor TN2 and the drain voltage of the transistor TP1 becomes the same correspondingly to the gate voltage of the transistor TN2, which is generated correspondingly to temperature change.

Describing this in more detail, it is assumed that, at a certain temperature, the voltage VD of the diode D (VD is a terminal voltage VBE of the diode D.) increases from a reference value and the voltage of the resister R becomes lower than the reference value. In such case, the drain current of the transistor TN2 is increased, so that the drain voltage of the transistor TN2, which is the load of the transistor TN2, is lowered. Therefore, the source-gate voltage difference of the transistor TP2 is increased, so that the source-drain current thereof is increased. As a result, the source-drain current of the transistor TP1 is also increased. Therefore, the drain voltage of the transistor TN1 is lowered correspondingly to the lower drain voltage of the transistor TN2. When the drain voltages of the transistors TN1 and TN2 become equal at every temperature, the operations is balanced and kept in the balanced state.

The above mentioned operation is reversed when the difference between the voltage VD of the diode D and the voltage VR of the resister R is in a direction in which the gate-source voltage of the transistor TN2 is lowered.

In such case, the gate-source voltage of the transistor TN2 becomes a sum of temperature characteristics of the voltage VD and the voltage VR since the voltage VD of the diode D has a negative temperature coefficient and the voltage VR of the resister R is a positive temperature characteristics. The sum of the temperature characteristics depends upon the operating current ratio of the current mirror circuit 11.

Now an operation, when the channel width (gate width) ratio of the current mirror circuit 11 of the reference current generator circuit 1 is 1:n, will be considered with using n as a parameter.

Since the reference current generator circuit 1 has the feedback loop as mentioned previously, the following equation (1) is established:

$$VGS1+VD=VGS2+ID2\cdot R \tag{1}$$

where VGS1 and VGS2 are gate-source voltage of the respective transistors TN1 and TN2, VD is a terminal voltage VBE of the diode D, R is a resistance of the register R, and ID1 and ID2 are drain currents of the respective transistors TN1 and TN2.

Gate-source voltage VGS is represented by $$VGS=Vth+\sqrt{4ID/\beta N} \tag{2}$$

where Vth is threshold voltage of the MOS transistor, ID is a drain current thereof, N is the number of electrons per unit area in a population inversion layer, β is a constant equal to W/L·μnCox, W/L=channel width/channel length, μn is electron mobility and Cox is a capacitance per unit area of a gate oxide film.

Assuming that the transistors TN1 and TN2 are paired transistors, the threshold voltage Vth of the transistors TN1 and TN2 is equal to β, so that ID1=ID2=ID.

Rearranging the equation (1) by inserting the equation (2) thereto, the equation (1) can be rewritten as follow:

$$(Vth+\sqrt{2ID/\beta N1})+VD=(Vth+\sqrt{2ID/\beta N2})+ID\cdot R \tag{3}$$

where N1 and N2 are numbers of electrons per unit area in the population inversion layers of the transistors TN1 and TN2, respectively.

The equation (3) can be rewritten as follow:

$$\sqrt{2ID/\beta}\cdot(\sqrt{1/N1}-\sqrt{1/N2})+VD-ID\cdot R=0 \tag{4}$$

From the equation (4), it is clear that the output current ID is a function of the terminal voltage VD, the resistance R, the electron numbers N1 and N2. Therefore, the output current ID depends upon temperature coefficients of VD, R, N1 and N2. From this fact, it is clear that the temperature characteristics of the output current ID can be changed correspondingly to the temperature coefficient of VD and R by using values of N1 and N2.

Figure 2:
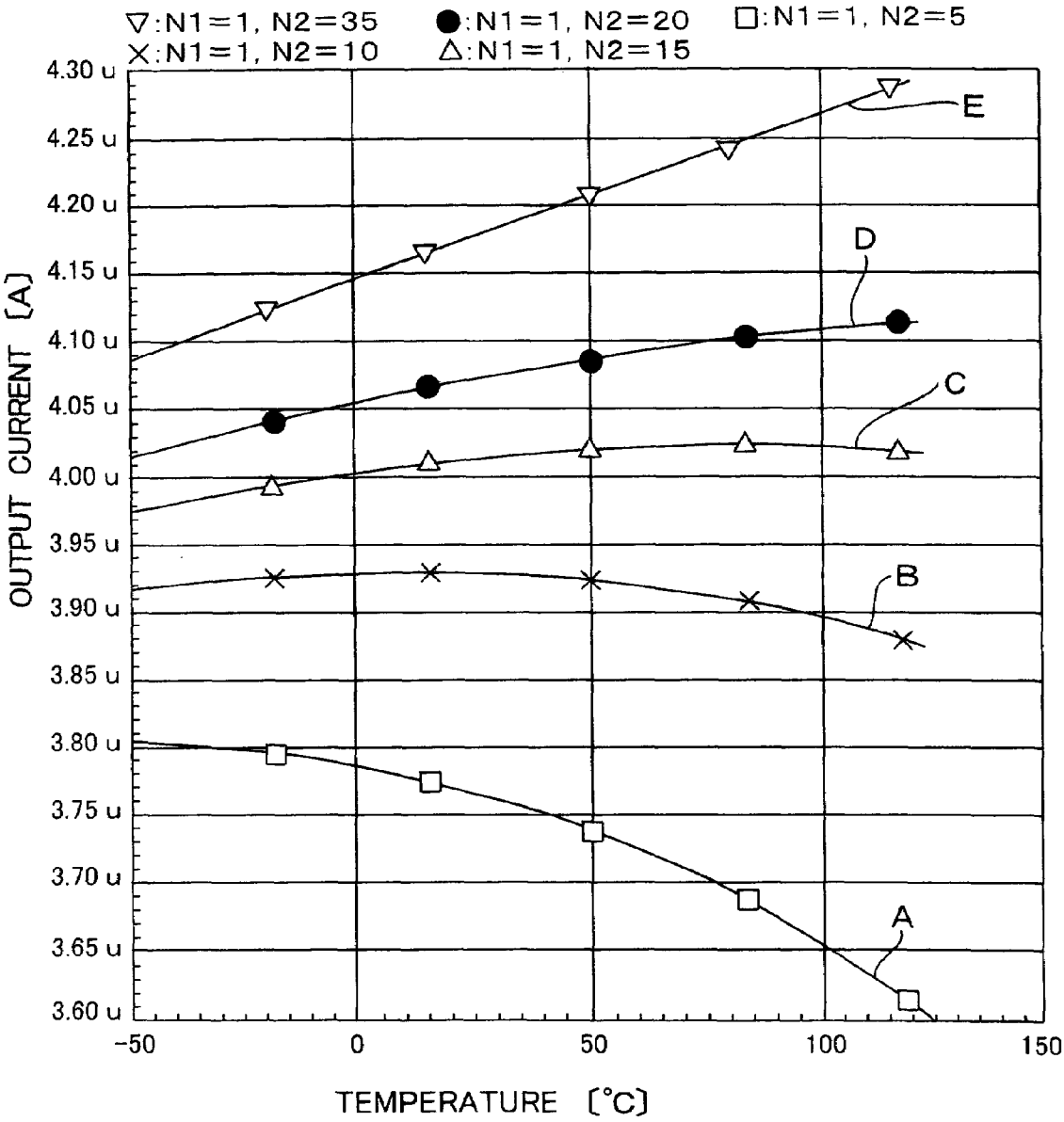
FIG. 2 is a graph showing temperature characteristics of drive currents when a channel width (gate width) ratio of an input side transistor to an output side transistor of a current mirror circuit constituting a reference current generator circuit is used as a parameter.

According to an investigation of temperature characteristics when N1 and N2 are changed with using the channel width (gate width) ratio of the transistors TN1 and TN2 as a parameter, a channel width (gate width) ratio vs. temperature characteristics such as shown in FIG. 2 can be obtained with respect to the output current of the reference current generator circuit 1R.

In FIG. 2, abscissa indicates temperature (° C.) and ordinate indicates output current (A) of the transistor TN2. N1:N2 corresponds to the channel width (gate width) ratio of the transistors TN1 and TN2.

A curve A in FIG. 2 is obtained when the channel width ratio of the transistors TN1 and TN2, that is, N1:N2, is set to N1:N2=1:5. The output current is reduced with increase of temperature. A curve B is obtained when N1:N2=1:10, which is substantially flat in a temperature range from −50° C. to +50° C. and slightly reduced with increase of temperature from +50° C. A curve C is obtained when N1:N2=1:15 and is substantially flat though slightly increases within the range from −50° C. to +100° C. A curve D is obtained when N1:N2=1:20 and increases with increase of temperature and a curve E is obtained when N1:N2=1:35 and increases more sharply than the curve D with increase of temperature.

Figure 3A:
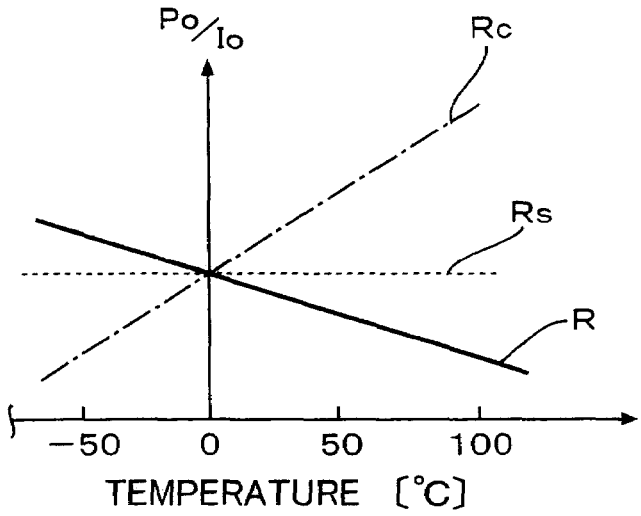
FIG. 3(*a*) to FIG. 3(*c*) show graphs for explaining general temperature characteristics with respect to an output current of luminous materials for primary R, G and B colors.
Figure 3B:
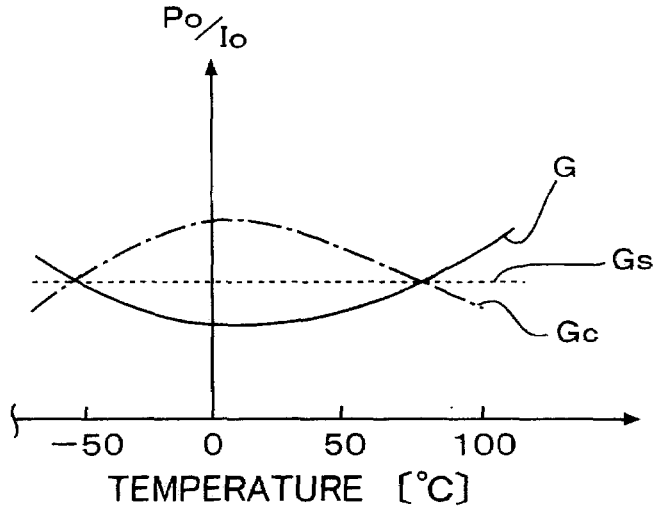
Figure 3C:
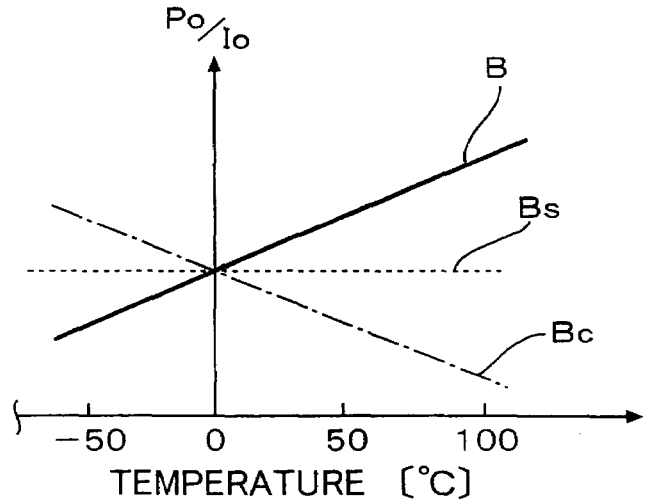

On the basis of these temperature characteristics curves, temperature coefficient capable of canceling the characteristics of luminous materials shown in FIG. 3(*a*) to FIG. 3(*c*) within the temperature range in which the display device having operating temperature range from −10° C. to +70° C. can be used has been investigated. According to the investigation, it has been found that N1:N2=1:18, N1:N2=1:13 and N1:N2=1:4 for respective R, G and B colors are optimal with respect to the currently available luminous materials for R, G and B colors.

According to this fact, the channel width ratios of the transistors TN1 and TN2 of the reference current generator circuits 1R, 1G and 1B in FIG. 1 are set to 1:18, 1:13 and 1:4, respectively.

With this setting of the channel width ratio of the transistors TN1 and TN2 as mentioned, luminance characteristics Rc, Gc and Bc shown by chain lines in FIG. 3(*a*) to FIG. 3(*c*) can be obtained.

Incidentally, since change of ratio by about 2 from the temperature characteristics shown in FIG. 3(*a*) to FIG. 3(*c*) can be considered as allowable ranges, a selection range of channel width ratio of the transistors TN1 and TN2 for R color becomes in a range from 1:16 to 1:20, a selection range of channel width ratio of the transistors TN1 and TN2 for G color becomes in a range from 1:11 to 1:15 and a selection range of channel width ratio of the transistors TN1 and TN2 for B color becomes in a range from 1:2 to 1:6.

As a result, the reference current from each of the reference current generator circuit 1R, 1G and 1B is changed correspondingly to environmental temperature and the regulated reference current from each of the white balance regulator circuits 2R, 2G and 2B is similarly changed. Responsive to the display data supplied from the MPU 9 through the register 7, each of the D/A conversion blocks 6*a* to 6*m* generates drive currents corresponding to luminance of the organic EL elements at their output terminals every moment as sink currents by amplifying the reference drive current generated by the white balance regulator circuits 2. Thus, the drive currents are outputted to pixel circuits of the organic EL panel through the column side output terminals (column pins).

The luminance characteristics with respect to temperature for R color is corrected as shown by characteristics Rs in FIG. 3(*a*), which is substantially flat within the temperature range from −50° C. to +70° C. For B and G colors, substantially flat luminance characteristics can be obtained in the temperature range from −50° C. to +70° C. as shown by the dotted curves GS and BS in FIG. 3(*b*) and FIG. 3(*c*).

Since the luminance curves Rs, Gs and Bs for R, G and B colors with respect to temperature are corrected to substantially flat as shown in FIG. 3(*a*) to FIG. 3(*c*), the white balance can be substantially kept unbroken even when the temperature of the display device is changed within the temperature range from −50° C. to +70° C.

Incidentally, the current mirror circuit 11 of each of the reference current generator circuits 1R, 1G and 1B includes the diode, which is connected in series with the input side transistor, and the resister, which is connected in series with the output side transistor. However, instead of the diode and the resister, it is possible to connect passive elements having temperature coefficients, which are opposite in direction, in series with the respective input and output side transistors of the current mirror circuit 11.

Further, it should be noted that the channel width ratio of the current mirror circuit 11 corresponds to the operating current ratio of the input side and output side transistors of the current mirror circuit 11, as is clear from the equation (4).

Further, the N channel MOS transistors used in the described embodiment can be replaced by P channel MOS transistors, or vice versa. Particularly, when the P channel MOS transistors are replaced by N channel MOS transistors, the transistors of the D/A converter circuit 4, which are arranged on the side of the power source, becomes the ground side and the sources of the transistors are connected to the ground line. However, in the case where the N channel MOS transistors of each of the D/A conversion blocks are replaced by P channel MOS transistors, sources of the transistors of the D/A conversion block becomes the ground side.

Although the outputs of the D/A conversion blocks are supplied to the output terminals as the drive currents in the described embodiment, it is possible to provide output stage current sources correspondingly to the respective output terminals and output the drive currents to the respective output terminals by driving the output stage current sources with the output current of the D/A conversion blocks.

Further, although the reference current generator circuit of the described embodiment is constructed with the MOS transistors, it is, of course, possible to construct the reference current generator circuit with bipolar transistors. When the reference current generator is constructed with bipolar transistors, the channel width (gate width) ratio of the current mirror circuit becomes an emitter area ratio.

Further, although the organic EL panel is of the active matrix type, which is driven by sink current in the described embodiment, the present invention can be applied to drive a passive matrix type organic EL panel. When the organic EL panel is of the passive matrix type, the drive currents, which are to be supplied to anodes of organic EL elements, become discharge currents.

Although the color display is described, the reference current generator circuit according to the present invention can be applied to an organic EL drive circuit for monochromatic organic EL panel, since the luminance change with change of temperature can be corrected.

What is claimed is:

1. A reference current generator circuit of an organic EL drive circuit for generating drive currents correspondingly to terminal pins of an organic EL panel on a basis of a reference current and current-driving said organic EL panel, comprising:

a first current mirror circuit including an input side transistor, an output transistor and passive elements respectively connected in series with said input side transistor and said output side transistor, temperature coefficients of said passive elements being opposite in characteristics; and a second current mirror circuit provided as a load circuit of said first current mirror circuit, for feeding back an output current of said output side transistor to an input of said input side transistor, wherein the drive current is generated on a basis of a current corresponding to a current generated in said output side transistor as the reference current and a ratio of operating currents of said input side transistor and said output side transistor is selected such that luminance change of organic EL elements with respect to temperature change is restricted.

2. The reference current generator circuit as claimed in claim 1, wherein the operating current ratio is selected such that the luminance change with respect to temperature change in a predetermined temperature range is substantially unchanged.

3. The reference current generator circuit as claimed in claim 2, wherein the predetermined temperature range is from −10° C. to +70° C. and luminance characteristics with respect to the temperature change is substantially flat within the predetermined temperature range.

4. The reference current generator circuit as claimed in claim 2, further comprising an output circuit having an output side transistor which composes a current mirror together with an output side transistor of said second current mirror circuit, said output side transistor of said output circuit outputting the reference current, wherein said passive elements are a diode and a resister.

5. The reference current generator circuit as claimed in claim 2, wherein said input side transistor and said output side transistor of said first current mirror circuit and transistors of said second current mirror circuit are MOS transistors, respectively, and the operating current ratio of said input side transistor and said output side transistor of said first current mirror circuit is equal to a channel width ratio of said input side transistor and said output side transistor of said first current mirror circuit.

6. The reference current generator circuit as claimed in claim 2, wherein said organic EL elements are provided correspondingly to three primary colors, respectively, and said reference current generator circuit is provided for each of the three primary colors.

7. The reference current generator circuit as claimed in claim 6, wherein the ratio of channel width for red color is selected from a ratio range from 1:16 to 1:20, the channel width ratio for green color is selected from a ratio range from 1:11 to 1:15 and the channel width ratio for blue color is selected from a ratio range from 1:2 to 1:6.

8. The reference current generator circuit as claimed in claim 7, wherein said input and output side transistors constituting said first current mirror circuit have paired characteristics.

9. An organic EL drive circuit for generating drive currents correspondingly to respective terminal pins of an organic EL panel on a basis of a reference current and driving said organic EL panel with the drive currents, comprising:

a reference current regulator circuit responsive to the reference current for generating a regulated reference drive current, said drive currents being generated on a basis of the regulated reference drive current; and a reference current generator circuit for generating the reference current, said reference current generator circuit comprising:

a first current mirror circuit including an input side transistor, an output transistor and passive elements respectively connected in series with said input side transistor and said output side transistor, temperature coefficients of said passive elements being opposite in characteristics; and a second current mirror circuit provided as a load circuit of said first current mirror circuit, for feeding back an output current of said output side transistor to an input of said input side transistor, wherein the drive current is generated on a basis of a current corresponding to a current generated in said output side transistor as the reference current and an operating current ratio of said input side transistor and said output side transistor is selected such that luminance change of organic EL elements with respect to temperature change is restricted.

10. The organic EL drive circuit as claimed in claim 9, wherein the operating current ratio is selected such that the luminance change with respect to temperature change in a predetermined temperature range is substantially unchanged.

11. The organic EL drive circuit as claimed in claim 10, wherein the predetermined temperature range is from −10° C. to +70° C. and luminance characteristics with respect to the temperature change is substantially flat within the predetermined temperature range.

12. The organic EL drive circuit as claimed in claim 10, wherein said reference current generator circuit further comprising an output circuit having an output side transistor which composes a current mirror together with an output side transistor of said second current mirror circuit, said output side transistor of said output circuit outputting the reference current, wherein said passive elements are a diode and a resister.

13. The organic EL drive circuit as claimed in claim 10, wherein said input side transistor and said output side transistor of said first current mirror circuit and transistors of said second current mirror circuit are MOS transistors, respectively, and the operating current ratio of said input side transistor and said output side transistor of said first current mirror circuit is equal to a channel width ratio of said input side transistor and said output side transistor of said first current mirror circuit.

14. The organic EL drive circuit as claimed in claim 10, wherein said organic EL elements are provided correspondingly to three primary colors and said reference current generator circuit is provided for each of the three primary colors.

15. The organic EL drive circuit as claimed in claim 14, wherein the channel width ratio for red color is selected from a ratio range from 1:16 to 1:20, the channel width ratio for green color is selected from a ratio range from 1:11 to 1:15 and the channel width ratio for blue color is selected from a ratio range from 1:2 to 1:6.

16. The organic EL drive circuit as claimed in claim 15, further comprising a first D/A converter circuit and a second D/A converter circuit, wherein said first D/A converter circuit is provided in said reference current regulator circuit to generate the regulated reference drive current by regulating the reference current according to data set and said second D/A converter circuit generates the drive currents or currents from which the drive currents are derived, correspondingly to said terminals pins of said organic EL panel in response to the regulated reference drive current and a display data.

17. The organic EL drive circuit as claimed in claim 16, wherein said second D/A converter circuit is constructed with a third current mirror circuit including an input side transistor and a plurality of output side transistors, the regulated reference drive current is inputted the input side transistor of the third current mirror circuit and said second D/A converter circuit generates a plurality of analog-converted currents correspondingly to said respective terminal pins by switching currents of said output side transistors of said third current mirror circuit according to a digital value of the display data.

18. The organic EL drive circuit as claimed in claim 17, wherein said reference current regulator circuit further comprises a current inverter circuit, said first D/A converter circuit is constructed with a fourth current mirror circuit including an input side transistor and a plurality of output side transistors and generates analog converted currents in the plurality of said output side transistors of said fourth current mirror circuit in response to the reference current supplied to the input side transistor of the fourth current mirror circuit through said current inverter circuit and the plurality of said output side transistors of said third current mirror circuit are provided correspondingly to weights of the display data to be converted.

19. The organic EL drive circuit as claimed in claim 18, wherein said current inverter circuit is constituted with a fifth current mirror circuit, said first current mirror, said third current mirror circuit and said fifth current mirror circuit are constructed with N channel MOS transistors, respectively and said second current mirror circuit and said fourth current mirror circuit are constructed with P channel MOS transistors, respectively.

20. An organic EL display device comprising:

an organic EL drive circuit having a reference current regulator circuit and a reference current generator circuit, for generating drive currents corresponding to respective terminal pins of an organic EL panel on a basis of a reference current and driving said organic EL panel;

said reference current regulator circuit responsive to the reference current for generating a regulated reference drive current, said drive currents being generated on a basis of the regulated reference drive current; and said reference current generator circuit for generating the reference current, said reference current generator circuit comprising:

a first current mirror circuit including an input side transistor, an output transistor and passive elements respectively connected in series with said input side transistor and said output side transistor, temperature coefficients of said passive elements being opposite in characteristics; and a second current mirror circuit provided as a load circuit of said first current mirror circuit, for feeding back an output current of said output side transistor to an input of said input side transistor, wherein a current corresponding to a current generated in said output side transistor of said first current mirror circuit is outputted as the reference current and an operating current ratio of said input side transistor and said output side transistor is selected such that luminance change of organic EL elements with respect to temperature change is restricted.

21. The organic EL display device as claimed in claim 20, wherein the operating current ratio is selected such that the luminance change with respect to temperature change in a predetermined temperature range is substantially unchanged.

22. The organic EL display device as claimed in claim 21, wherein the predetermined temperature range is from −10° C. to +70° C. and luminance characteristics with respect to the temperature change is substantially flat within the predetermined temperature range.

23. The organic EL display device as claimed in claim 22, wherein said organic EL panel is of the active matrix type.

* * * * *